US005816691A

United States Patent [19]

Gordin et al.

[11] Patent Number: 5,816,691

[45] Date of Patent: Oct. 6, 1998

[54] APPARATUS AND METHOD FOR REDUCING GLARE CAUSED BY REFLECTIONS FROM A LENS OF A LIGHTING FIXTURE

[75] Inventors: Myron K. Gordin; Timothy J. Boyle, both of Oskaloosa, Iowa

[73] Assignee: Musco Corporation, Oskaloosa, Iowa

[21] Appl. No.: 729,728

[22] Filed: Oct. 7, 1996

[51] Int. Cl.[6] ..... F21V 7/16

[52] U.S. Cl. ..... 362/283; 362/298; 362/301; 362/323; 362/346

[58] Field of Search ..... 362/153.1, 234, 362/237, 247, 256, 282, 298, 301, 322, 323, 346, 261, 283

[56] References Cited

U.S. PATENT DOCUMENTS

| | | | |
|---|---|---|---|
| 4,499,529 | 2/1985 | Figueroa | 362/283 |
| 4,872,098 | 10/1989 | Romano | 362/283 |
| 5,647,661 | 7/1997 | Gordin | 362/283 |

*Primary Examiner*—Stephen F. Husar
*Attorney, Agent, or Firm*—Zarley, McKee, Thomte, Voorhees & Sease

[57] ABSTRACT

An apparatus and method of minimizing glare from a lighting fixture using reflective glass as a lens and where the fixture is configured or desired to be configured to converge light to the same point in space. The method aims a top-most or bottom-most portion of the main reflector so that light reflected from it travels perpendicularly to the lens. Remaining portions of the main reflector either automatically adjust to the top-most or bottom-most portion or are adjusted so that glare is minimized by reimaging of the light source caused by reflectance from the glass lens in a manner that such reflectance is blocked wholly or partially by the light source and/or the holder of the light source and/or the supporting structure positioning the holder of the light source in place inside the housing. The apparatus according to the invention includes a lighting fixture having a housing, a light source and reflector in the housing, and a glass have reflecting properties on the housing. The reflector is configured to convergence all light to the same point in space. Either a top or bottom portion of the reflector is oriented relative to the light source and the lens so that reflected light from that portion travels perpendicularly into the lens. The remainder of the reflector is oriented relative to the portion so that all light continues to converge to the same point in space.

22 Claims, 6 Drawing Sheets

APPARATUS AND METHOD FOR REDUCING GLARE CAUSED BY REFLECTIONS FROM A LENS OF A LIGHTING FIXTURE

INCORPORATION BY REFERENCE

The contents of co-pending, co-owned U.S. Ser. No. 08/375,650, now U.S. Pat. No. 5,647,661, including specification and drawings, is incorporated by reference herein.

BACKGROUND OF THE INVENTION

A. Field of the Invention

This invention relates to lighting fixtures, and in particular, to apparatus and methods to reduce glare caused by reflections from the lens of the lighting fixture.

B. Problems in the Art

Most lighting fixtures with high intensity light sources utilize a lens or transparent cover through which light from the fixture passes to a target or in an intended direction or manner. An example of such a combination is a metal halide arc tube positioned relative to a reflector inside a housing, which surrounds the arc tube, the reflector, and supporting components. A glass lens on or in one side or portion of the housing provides the outlet for the light from the fixture.

One type of lighting fixture that is of primary relevance to the invention comprises a high intensity light source, such as is possible with an arc tube, which is positioned at or near the focal point of a reflector having a shape generally parabolic, elliptical or a combination thereof, positioned inside a housing having a glass lens. The reflector can either be comprised of segments or a single piece. If segmented, each segment is adjustable around an axis and the set of segments is adjustable relative the light source and housing. If a single piece, the reflector is adjustable relative the light source and the housing.

These types of fixtures are particularly useful when a distinct cutoff is desired at a margin of the beam produced by the fixture. An example would be if the top of the beam is desired to be cut off in a horizontal plane. This is accomplished by aiming the segments (if segmented) or shaping the reflector (if a single piece) so that light from the reflector converges to a point or line in space that defines the cut off boundary or margin of a portion of the beam of the fixture.

Conventional glass has an interesting property. Even though transparent, each surface of conventional glass does not pass all light that is sent to it, but rather reflects a measurable percentage. Conventional clear glass, for example, may reflect on the order of 4% of the light that attempts to pass through it, at both surfaces of a single pane of glass. Cumulatively this results in approximately 8% of the light being reflected back into the fixture. Although about 92% passes, 8% is a significant amount because it diminishes the amount of usable light to the target or to be used, and the reflected light can cause unwanted things such as glare and heat build up.

One way to deal with the glare problem is to use what will be called non-reflective glass as the lens or transparent cover to the outlet of light from the lighting fixture. By methods well known in the art, non-reflective glass reduces the reflectance of light at the boundary surfaces of the glass sufficiently to eliminate or effectively diminish to an acceptable level the problems mentioned above However, non-reflective glass is very expensive compared to conventional glass. For example, a conventional glass lens on the order of, for example 500 to 900 square inches, might cost on the order of five dollars, whereas a similarly sized glass lens coated to make it essentially non-reflective, can cost on the order of one-hundred and twenty-five dollars.

Still further, it has been found that at least some types of non-reflective glass are not durable or long-lasting in their non-reflective characteristics, especially when used in outdoor settings for the fixtures.

There is therefore a real need in the art to address and remedy the above problems and concerns. It is therefore a principle object and feature of the present invention to provide an apparatus and method of reducing glare caused by reflections from a lens of a lighting fixture of the type described above which improves over or solves the problems and deficiencies in the art.

Other objects and features of the present invention include providing an apparatus and method as above-described which:

- inexpensively treats certain glare and durability problems for such fixtures;
- does not detract from the performance or directional control or cutoff of light from the fixture.

These and other objects, features, and advantages of the present invention will become more apparent with reference to the accompanying specification and claims.

SUMMARY OF THE INVENTION

The present invention includes a method for minimizing or reducing glare from a lighting fixture having a reflector and light source positioned in a housing. The housing has a glass lens that reflects a percentage of light back into the fixture from the reflector positioned inside a housing where the reflector focuses light from its various portions in a manner such that all light is not perpendicular to the glass lens, but converges light in a manner such that produces a distinct cutoff along a margin of a portion of the beam.

The method includes determining the focal length, aiming direction and distance, and reflector shape involved for the application. Depending on these factors, one of the top or bottom portions of the reflector is aimed so that it reflects light that is reflected by the lens in a manner that is perpendicular to the lens. The remainder of the reflector is then adjusted based on the adjustment made to the top or bottom portion, while maintaining convergence of light from the reflector to the same point or line in space to maintain the cutoff of a margin of the beam. The adjustment of the top-most or bottom-most portion, and the remainder of portions, causes the image of the light source reflected back into the fixture by the lens to be blocked by the light source or its supporting structure, thus reducing or eliminating glare for at least certain viewing angles to the fixture.

The apparatus according to the invention includes an enclosure, a light source supported by supporting structure inside the enclosure, a reflector in the enclosure to capture light from the light source and direct it out of a glass lens of the housing, the glass lens reflecting a portion of the light aiming out of the fixture, back into the fixture. The reflector is oriented relative to the lens so that light is reflected by the lens back into the fixture, then reflected off of either the top or bottom portion of the reflector, and then reflected generally perpendicularly back to the lens. The remainder of the reflector is oriented relative to the top or bottom portion so that all portions of the reflector converge light to the same point or line in space relative to one margin of the entire beam created by the fixture.

The reflector can either be made of segments or can be one piece. In the case of a one piece reflector, once the top or bottom portion is aimed to reflect perpendicular to the lens, the remainder of the reflector is adjusted accordingly. In the case of a segmented reflector, if the segments are independently adjustable, once the top or bottom segment is adjusted to reflect perpendicularly into the lens, the remaining segments must be adjusted, keyed off of the top or bottom reflector, to have all segments converge light to the same point in space.

DETAILED DESCRIPTION OF THE PREFERRED EMBODIMENT

Figure 2:
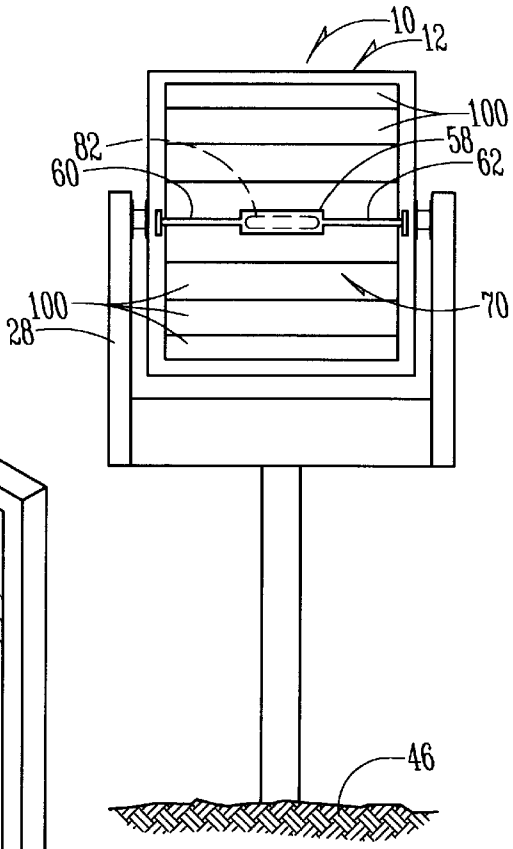
FIG. 2 is a reduced-in-size front elevational view of the fixture of FIG. 1.

In order to achieve a better understanding of the invention, a preferred embodiment will now be described in detail. Frequent reference will be taken to the drawings, which are summarized immediately above. Reference characters (numerals and/or letters) will be used to indicate certain parts or locations in the drawings. The same reference characters will be used to indicate the same or similar parts or locations throughout the drawings, unless otherwise stated.

Figure 1:
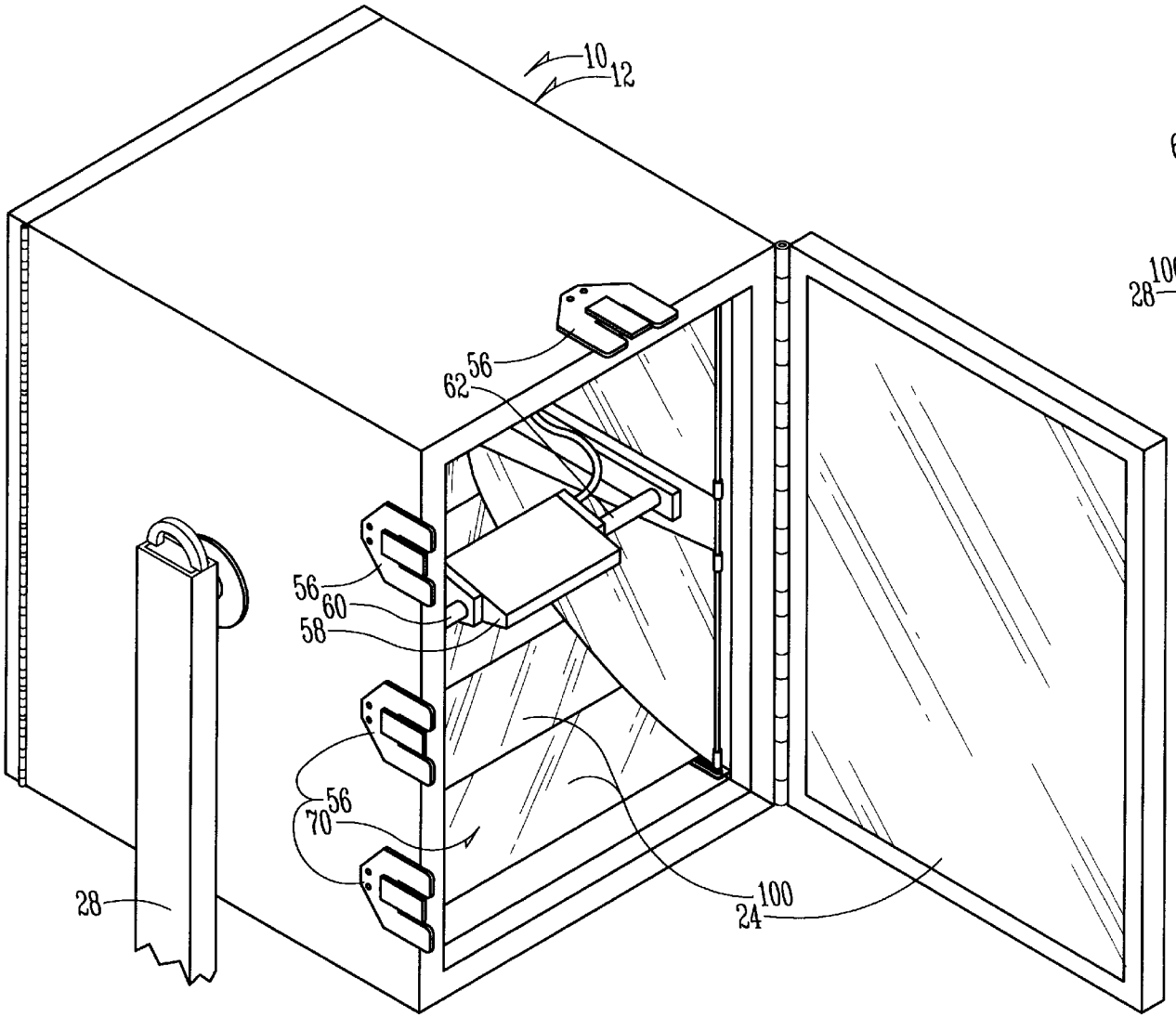
FIG. 1 is a perspective view of a light fixture having a high intensity light source and reflector contained within a housing that includes a glass lens on one side of the housing.

FIG. 1 shows a lighting fixture 10 which includes a box-shaped exterior housing 12. One side of housing 12 comprises a glass lens 24 that can be held in a closed position by latches 56.

A base 28 (basically a gimbal mount) allows the housing to be adjusted in orientation relative to a target or direction. Base 28 could be placed on the ground 46 or on some supporting structure (see FIG. 2).

Figure 3:
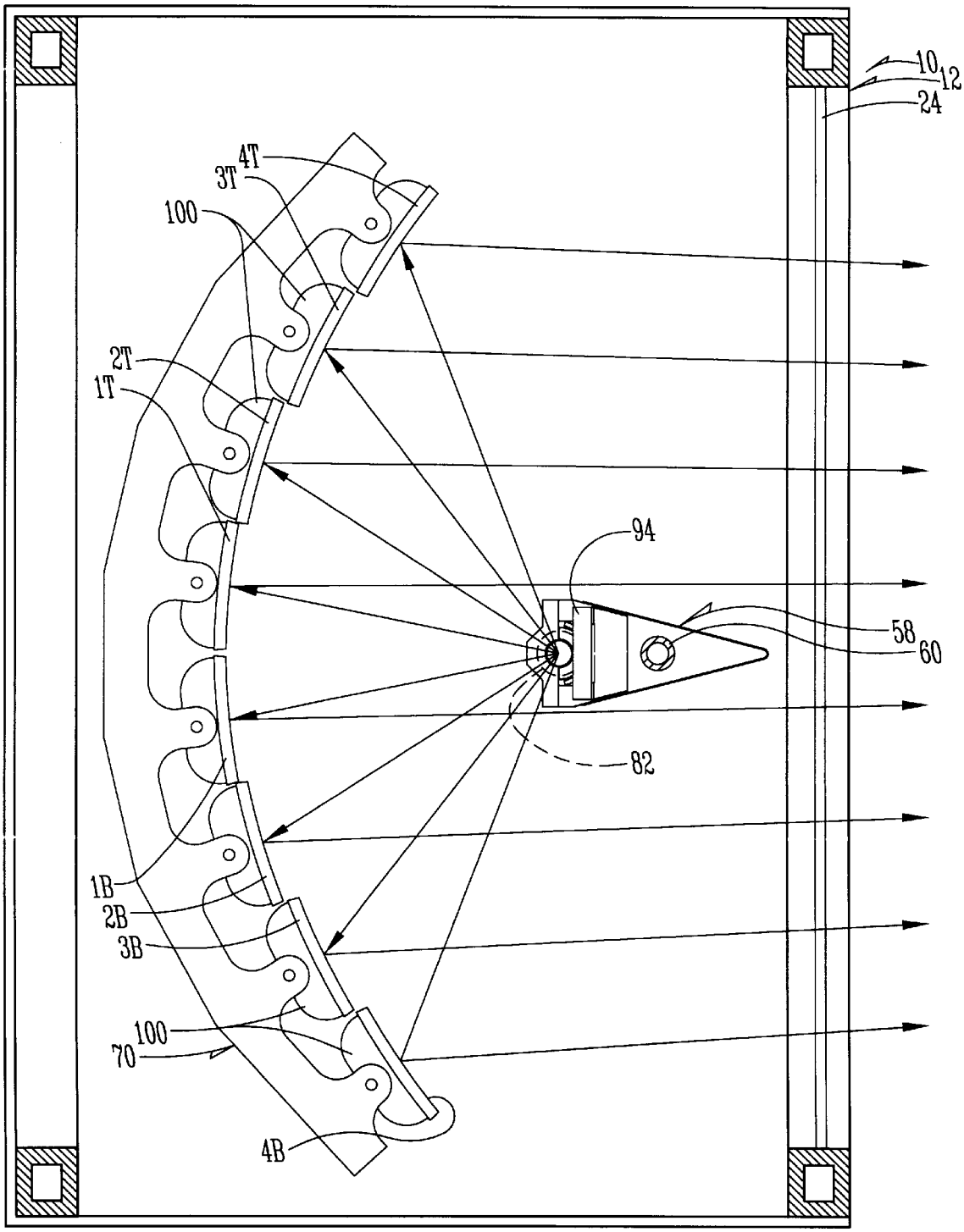
FIG. 3 is an exposed side elevational view of the light source, its holder, and the reflector of the fixture of FIG. 1 and shows generally how light emanates from the light source and is controlled by the reflector.

Light from fixture 10 emanates from lens 24 in a manner controlled by the configuration of a light source and reflector or reflectors inside housing 12. FIGS. 1, 2, and 3 show a light source 82 held in position by a holder 58 having a cross-bar 60/62 that extends horizontally across the interior of housing 12 to support holder 58 in the position shown. Holder 58 is a generally triangular-in-cross-section member that includes directly adjacent to light source 82, a reflective member 94 (see FIG. 3), that is on the same order of size as light source 82. For example, the light source 82 is a 2000 watt metal halide arc tube, such as is well-known in the art and available from a variety of commercial sources such as Philips, Sylvania, and the like.

In this embodiment, two reflectors assist in capturing and controlling light from light source 82 in a manner which is then re-directed out of housing 12 through lens 24. In particular, in the preferred embodiment, what will be called primary reflector 94 is positioned on the front facing side of arc tube 82 and is on the same order of size as arc tube 82. It can be a separate piece at or near the surface of arc tube 82, such as quartz which is mirrored or coated with a dielectric coating which reflects at least visible light. It also can be a coating directly applied to arc tube 82, for example a dielectric coating applied to the outside surface of the arc tube. One example of such a coating is a dielectric, dichroic thin film of zirconia/silica or aluminum oxide deposited onto arc tube 82 by a sputtering process. An example of such a process is disclosed by N. Boling, B. Wood and P. Morand, of Deposition Sciences, Inc. of Santa Rosa, California, in a publication entitled "A High Rate Reactive Sputtering Process of Batch, In-line, or Roll Coaters", 1995 Society of Vacuum Coaters 38th Annual Technical Conference Proceedings, (1995) ISSN 0737–5921, pp. 286–289. Deposition Sciences, Inc. offers a sputtering procedure under its MicroDyn™ Activated Sputtering System (patent pending). Other methods are possible.

For more particulars of light fixture 10, light source 82, holder 58, cross-bar 60 and reflective member 94 (which could alternatively and preferably be a coating directly applied to the exterior of arc tube 82), reference can be taken to co-owned and co-pending application Ser. No. 08/375,650, filed Jan. 20, 1995, to inventor Myron K. Gordin, and which is incorporated by reference herein now U.S. Pat. No. 5,647,661

A principal aspect of fixture 10 is that light from arc tube 82 is not allowed to emanate directly through lens 24. Reflective member 94 redirects light that attempts to travel directly forward, and sends that light back through arc tube 82 and toward what is called a secondary reflector 70, which here is made up of a plurality of individually adjustable segments 100. Member 94 does not allow light to project directly out of fixture 10 from arc tube 82, but reflects it back into fixture 10 where it is controlled by reflector 70.

Light from the back, top and bottom of arc tube 82 travels directly to reflector 70 and is therefore also controlled by reflector 70. In this manner, no light is allowed to directly emanate from the fixture without being captured and controlled by reflector 70, and in this manner a controlled, concentrated beam can be formed and emanate through lens 24.

By reference to FIG. 20 of Ser. No. 08/375,650, now U.S. Pat. No. 5647,661 and the accompanying disclosure, it is to be understood that the shape of reflector 70 is governed by the following principles. The top-most portion of each segment 100 determines the top margin of the sub-beam each segment creates. In other words, each segment 100 generates a sub-beam of generally rectangular shape (corresponding roughly to the shape of a segment 100—that is elongated horizontally). The top margin of the sub-beam is the top edge of the horizontally elongated rectangular sub-beam shape. This is because light from the bottom-most part of the arc tube 82 that travels directly to the top-most part of each segment 100 has the greatest angle of incidence, and thus the highest reflection angle out of fixture 10.

Therefore, by adjusting each segment 100 so that its highest margin in the horizontal plane aligns with the highest horizontal margin of the sub beams of each segment 100, a distinct cutoff of the whole beam from fixture 10 is established. As disclosed in Ser. No. 08/375,650, now U.S. Pat. No. 5,647, 661, this can be used to light a race track, and cutoff light at the top of the whole beam so that it does not extend above the outer retaining wall of the track and fall on spectators.

To gain control over light from light source 82 and light which is directly rearwardly by reflective member 94, segments 100 are placed along a curve. That curve roughly simulates a parabola, an ellipse, or a combination of the two. Other shapes are possible. Each segment 100 can be pivoted about a horizontal axis to change its orientation to arc tube 82, which is elongated horizontally. It is to be understood, however, that reflector 70 is not a true parabola because segments 100 are adjusted to produce the cutoff explained above. A true parabola would reflect all light in parallel fashion. Reflector 70 slightly alters this so that light from the top of each segment that is received from the bottom-most part of arc tube 82 that it "sees" converges to the same point (here the same horizontal line in space). Thus, all rays reflected by reflector 70 are not parallel. As a result, at least some rays are not parallel to each other or the lens 24. This being the case, at least some rays hit lens 24 at a non-perpendicular angle of incidence, the rays are reflected back into reflector 70, and may cause glare.

With a perfect parabolic reflector, assuming the light source is at the focal point, all rays would be parallel. If the lens is perpendicular to the parallel rays, any reflection from the lens would travel back to the reflector and to the light source, where it would be blocked from view by the light source (or its holder). No or little glare would occur.

As shown in FIGS. 2 and 3, by appropriate positioning of segments 100, a controlled concentrated beam can be created by the composite action of the plurality of segments. As is explained in more detail in Ser. No. 08/375,650, now U.S. Pat. No. 5,647,661, each segment 100 acts as a mirror and projects a reflection. Each reflection from each segment can be compositely aimed so that adjacent reflections barely touch. Alternatively, certain reflections can be intentionally overlapped, which is advantageous if a part of the composite beam must travel farther distances than another part of the composite beam, and the farther area is to be lighted at or about the same intensity as the nearer area.

Still further, fixture 10 is useful if one wants either all segments 100 to project their light to a common point of convergence, or if each segment is desired to be aimed so that the top part of each reflection cuts off at the same level. The latter situation is particularly beneficial if a precise cutoff of light is desired at, for example a retaining wall of a race track. The track and the retaining wall would be lighted, but the spectators beyond the retaining wall would not.

Figure 4:
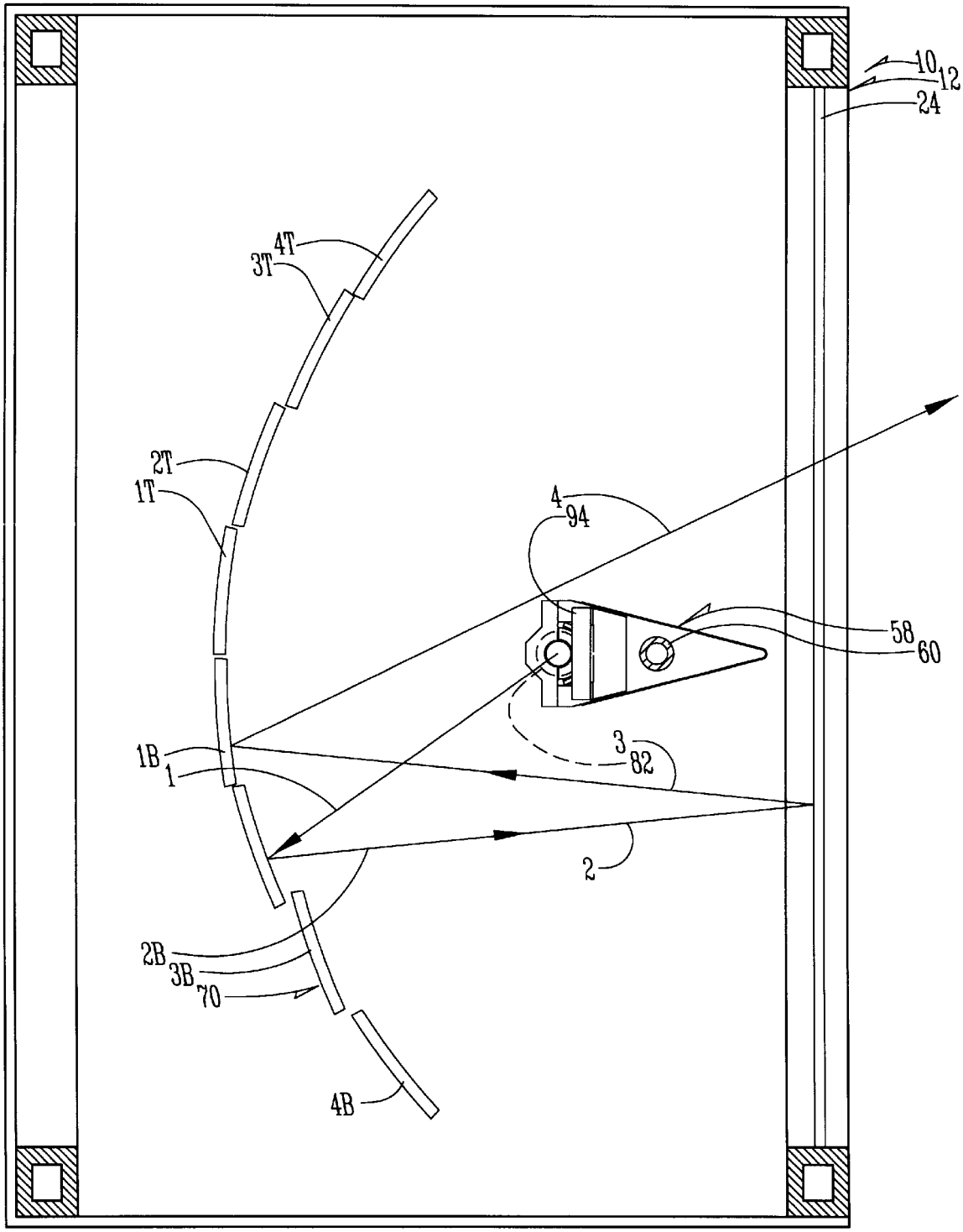
FIG. 4 is a diagrammatic depiction of the light emanating from the fixture of FIGS. 1–3 in a manner which causes glare.

In the situation where a cut off in a horizontal plane is desired, or light forming the top margin of the beam from fixture 10 from each of the segments 100 is desired to converge to a point (or line) in space in front of fixture 10, problems may exist. FIG. 4 illustrates such a problem that can exist for fixture 10, if conventional glass is used for lens 28, that is, glass which reflects a portion of the light that passes through it (can be on the order of 4% of light at each surface). Segment 1B in FIG. 4 is aimed so that light from arc tube 82 (see reference number 1) will reflect in a path (see reference number 2) that is perpendicular to lens 28. Approximately 92% of that light will pass through lens 28 and outward.

However, approximately 8% will reflect off lens 28 (see reference number 3) and back into reflector 70. In this example, light ray 3 reflects from segment 1B along a path (see reference number 4) that passes over arc tube 82, bar 60, and holder 58 and out lens 28. Many times this can cause glare in the eyes of those in the line of sight of the front of fixture 10. This is particularly true for viewing angles above horizontal to the fixture. The primary range of concern for the preferred embodiment viewing angles of 0 degrees to 30 degrees above horizontal for the fixture. As can be seen in FIG. 4, the reflection caused by lens 24 extends above the horizontal plane through arc tube 82 (see ray 4).

If non-reflective glass for lens 28 were used, rays 3 and 4 would not be produced, or at least would not exist at a level of intensity to produce bothersome glare. Here, though, lens 28 is reflective (conventionally) and the problem exists.

Figure 5:
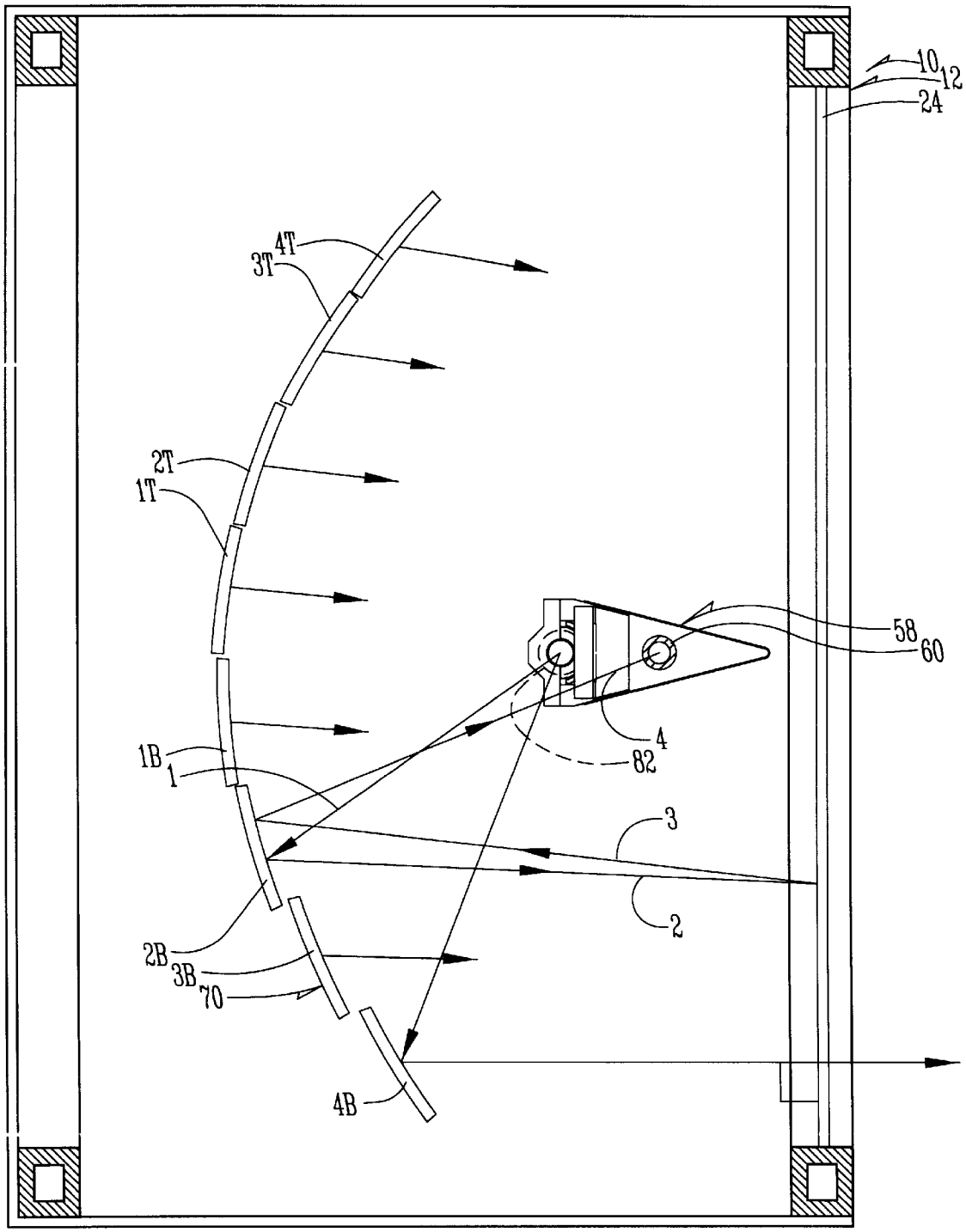
FIG. 5 is similar to FIG. 4, but shows the fixture of FIG. 4 in a configuration that eliminates or reduces glare for certain viewing angles to the fixture.

FIG. 5 illustrates how the glare problem can be treated. Segment 4B is changed from its position in FIG. 4 and is aimed so that light from arc tube 82 reflects (see reference number 5) perpendicularly to lens 28. Because it is desired that all segments 100 must converge light to the same point in space, the other segments 3B, 2B, 1B, 1T, 2T, 3T, 4T are in order aimed to follow the aiming of segment 4B (all segments still converge light to the same point in space).

As shown in FIG. 5, ray 1 would reflect off segment 1B in a path 2 which results in reflection in path 3 from lens 28 that returns to segment 1B. However, segment 4B is aimed so that light travels from it in a path perpendicular to lens 28. Essentially in this example segment 4B is thus tilted slightly downward from its position in FIG. 4. By then re-aiming the other segments to converge to the same point as segment 4B, they also are tipped slightly downward. In FIG. 5 it can be seen that path 3 is such that its reflection (ray 4) from segment 1B goes into arc tube 82 and is blocked by arc tube 82, or holder 58, or even by bar 60. Thus, glare is eliminated or reduced for the viewer of fixture 10 at or above a horizontal plane through light source 82.

It has been found that with a set-up like FIGS. 4 and 5, where the focal distance between arc tube 82 and segments 1B or 1T is relatively short compared to the height of reflector 70 (here the focal length is around 6 "and the reflector height is around "), adjustment or re-aiming of bottom segment 4B to perpendicular reflectance relative to lens 28, and then re-aiming of the remaining segments to converge to the same point in space as bottom segment 4B, serves to eliminate or reduce glare.

Figure 6:
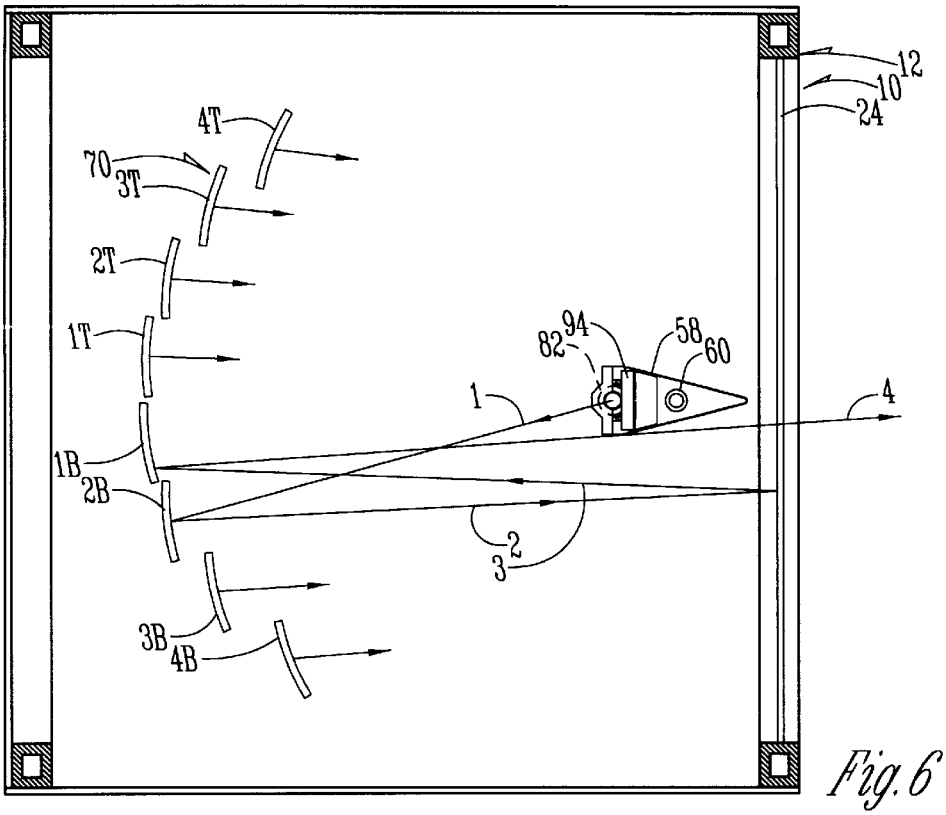
FIG. 6 is similar to FIG. 4, but shows a fixture having a larger housing and a longer focal point than that of FIG. 4.
Figure 7:
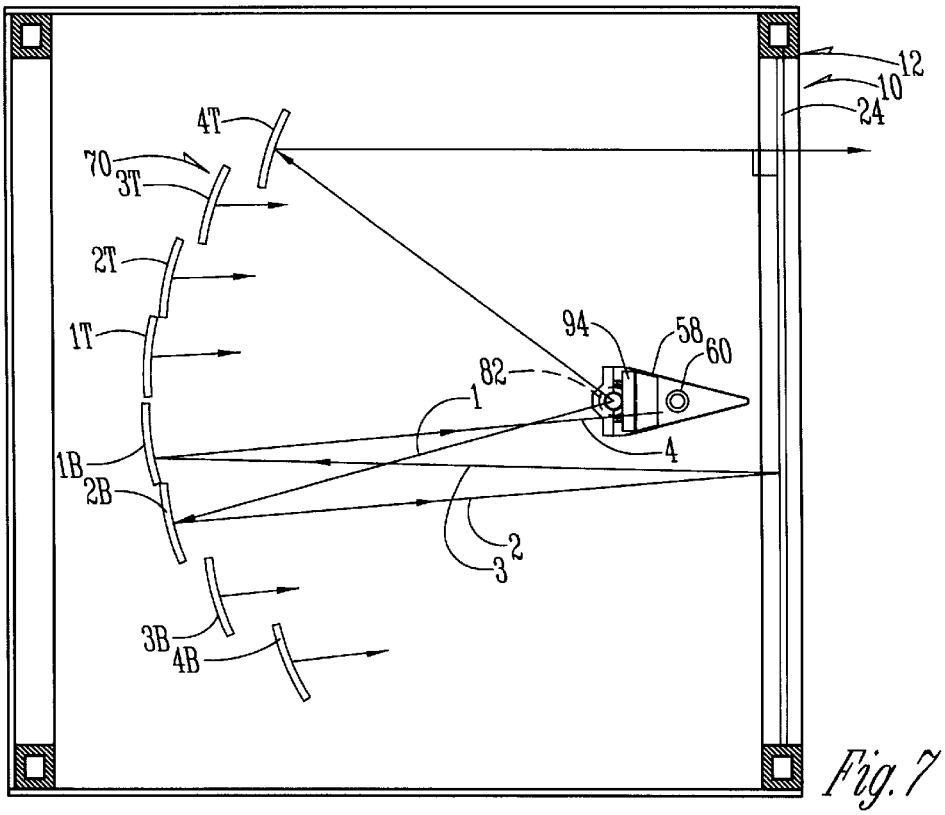
FIG. 7 is similar to FIG. 5, but involves eliminating or reducing glare for certain viewing angles to the fixture in the larger fixture of FIG. 6.

FIGS. 6 and 7 depict a fixture 10 having a distance between arc tube 82 and segments 1B or 1T substantially larger than in FIGS. 4 and 5. Similar principles apply to eliminate or reduce glare for similar viewing angles. If segment 1B is again aimed to converge to a point in space and reflects light perpendicular to lens 28 the light ray off of the lowest point on arc tube 82 (going highest off of segment 100) is aimed perpendicular. The rest of the light rays from the segment 100 goes below and all others are aimed to converge to the same point, ray 3 (reflected by conventional glass 28) would result in ray 4, which in this example passes under arc tube 82, holder 58 and bar 60 and can cause glare in a viewer's eyes. The larger focal length (here 20") with the same reflector height (around 32") results in the segments being relatively more vertical than those in the shorter focal length fixture of FIGS. 4 and 5.

To eliminate or reduce glare in this example the top-most segment 4T is first re-aimed so that it reflects light in a path 6 that is perpendicular to lens 28. The remaining segments 3T, 2T, 1T, 1B, 2B, 3B, and 4B are then re-aimed to the point of convergence with ray 7 of segment 4T. By doing so segment 4T is effectively tipped slightly downward, as are all other segments. It has been found that this results in a slight downward tipping of segment 1B that in turn results in ray 4 passes into arc tube 82 and/or holder 58 and/or bar 60, which block(s) ray 4 and thus eliminates or reduces glare for at least viewing angles above the horizontal plane through arc tube 82.

As can be appreciated by those skilled in the art, the foregoing examples, using single ray tracings, are greatly simplified to convey the general principles of the invention. The glare from a fixture can be empirically determined by simulating at a factory or testing facility the desired aiming of the fixture and the point of convergence of the reflections of the segments. Re-aiming of the top-most or bottom-most segment, followed by re-aiming of all other segments such that glare is minimized, can be empirically determined by trial and error.

It is furthermore understood that after re-aiming of the segments to minimize glare, which generally results in the slight downward tipping of all segments, when installed for use, the fixture 10 generally will have to be tipped up slightly in its aiming so that the point of convergence is where it should be. This can be easily accomplished with fixture 10 because of the gimbal mount 28.

In operation, the invention can be accomplished as follows. First basic factors regarding the fixture and its use are determined. For example, the shape and focal length of the fixture is determined. Its reflecting characteristics are then known. The aiming direction and distance is determined, as is the desired horizontal cutoff for the fixture. The point of convergence in space is then known.

Either at the factory or on-site, secondary reflector 70 can be aimed and configured to achieve the convergence to the same point in space (the desired cutoff line) for the given aiming distance. Depending on whether the focal length is relatively short (see FIGS. 4 and 5) or long (FIGS. 6 and 7), the top or bottom segment 100 is aimed so that it reflects light reflected by lens 24 back into fixture 10 in a manner that is generally perpendicular to lens 24. This can be accomplished by (a) placing the lens perpendicular to gravity or to the ground or floor and (b) measuring the distance from floor to bottom mirror segment 100, (c) moving out the distance to where you want cutoff to occur in the intended use (e.g. 150'), (d) placing a mark on a wall or vertical member positioned at 150' (corresponding to the previous measured distance between the floor and the bottom mirror).

Adjusting the bottom mirror so that the upper margin of its beam matches the mark on the wall 150' away confirms that the bottom segment 100 is perpendicular to the floor. One then knows the bottom segment is perpendicular to lens 24 because it is perpendicular to the floor also. It has been found for relatively wide beams (generally shorter focal lengths such as the approximately 6" focal length example discussed above) the bottom segment 100 should be first adjusted. For relatively narrow beams (generally longer focal lengths, such as the approximately 20" focal length example discussed above) the top segment 100 is usually adjusted.

The remaining segments 100 are in turn aimed relative to the aimed top or bottom segment 100 so that all segments 100 continue to converge light to the same cutoff line at the upper margin of the beam from fixture 10, thus preserving the desired ability to achieve cutoff in a horizontal plane. As shown by comparing FIG. 5 with FIG. 4, and FIG. 7 with FIG. 6, the aiming of the other segments basically involves a slight downward tilting of each. This in turn slightly lowers the rays 4 in FIGS. 4 and 6, redirecting them in a fashion that they are blocked at least substantially by light source 82, holder 58, and/or bar 60. No glare from the re-reflection of light cause by reflective glass lens 24 can be seen by viewers, at least at angles roughly up to 30 degrees above a horizontal plane through light source 82.

The above configuration of a fixture 10 to minimize glare caused by lens 24 can be accomplished in a factory setting or at the actual location for using the fixture. In either case, once the aiming of the segments 100 is accomplished, the housing 12 can be adjusted relative to its mount 28 to pre-aim the fixture. This also can be done at the factory because the needed information about where the fixture will be positioned, its aiming distance and direction, and the desired cutoff are usually pre-known. However, the fixture can be aimed at the site of its use. Of course, existing fixtures 10 can be "retrofitted " by re-aiming segments 100 to reduce or eliminate glare even though they presently cause glare.

The included preferred embodiment is given by way of example only, and not by way of limitation to the invention, which is solely described by the claims herein. Variations obvious to one skilled in the art will be included within the invention defined by the claims.

Figure 8:
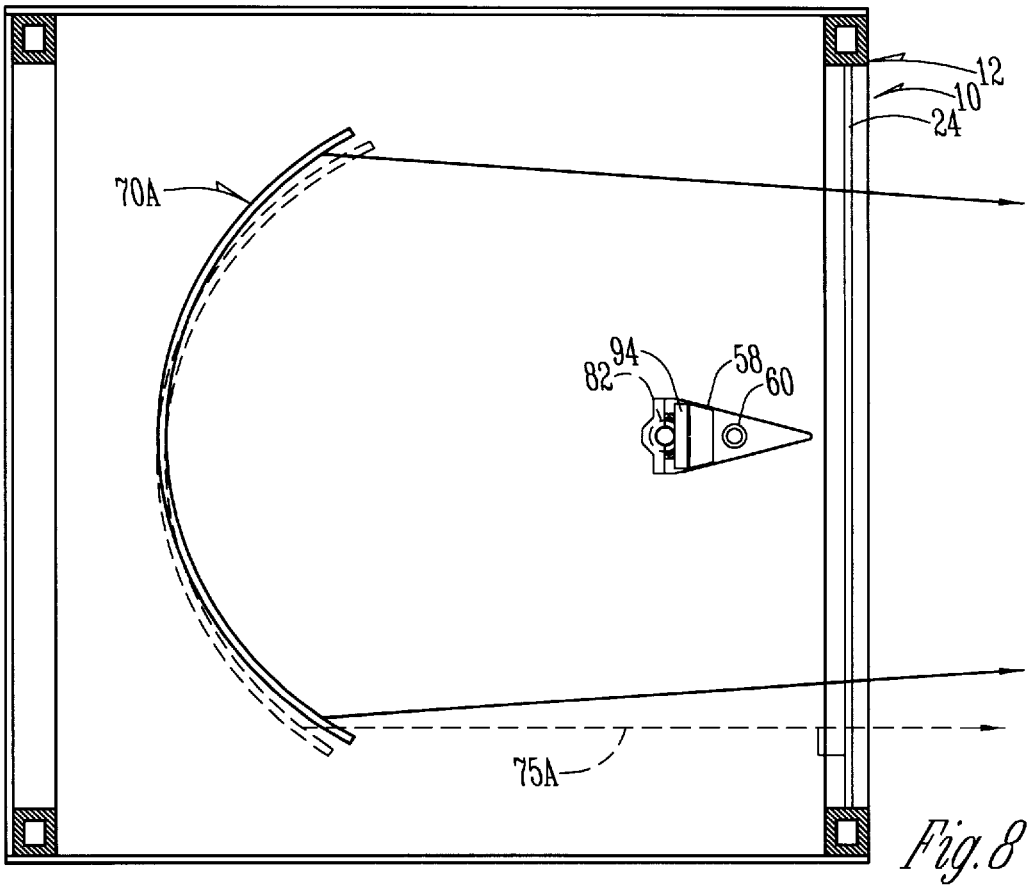
FIG. 8 is similar to FIG. 6, but shows in solid lines a one piece reflector and in ghost lines a repositioning of the reflector to eliminate or reduce glare for certain viewing angles to the fixture.

For example, the invention can also be used with single piece reflectors 70 or multi-piece reflectors 70 that have pieces or segments that are not adequately adjustable to re-aim each as disclosed above. It these cases, the procedure simply will involve aiming a top or bottom portion of the reflector so that reflections back into the fixture from lens 24 are in turn reflected perpendicular to lens 24. This adjustment or orientation of such a reflector will automatically result in the other portions of the reflector being re-aimed, so to speak, so that light which previously would cause glare, is now blocked by the light source, holder, or bar, like described above. An example of this is shown at FIG. 8. Single piece reflector 70A is formed so that light converges to a single point or line in space. In certain positions, including the one shown in solid lines in FIG. 8, the orientation of reflector 70A to light source 82 causes glare. It could be the same glare caused by reflector 70 in FIG. 6.

The glare can be reduced by tipping reflector 70A slightly downward or upward(see dashed lines) so that one of the bottom or top portions of reflector 70A reflects light from light source 82 perpendicularly into lens 24 (see dashed line for this example 75A). By doing so, the whole reflector 70A would be tipped slightly down or up. By the same laws of reflection as discussed with regard to FIGS. 4–7, light reflected back into fixture 10 by lens 24 would reflect off reflector 70A back to light source 82, or holder 94 or cross bar 60, which would reduce glare for viewing angles, at least 0 to 30 degrees above a horizontal plane through light source 82.

It is to be understood that glare caused by lens 24 is not always of concern. For example, glare outside 0–30 degrees above horizontal is generally not of concern because persons beyond the aiming point or horizontal cutoff of the fixture will not be affected. Therefore, as described above, when the lens causes a re-imaging of the arc tube above in the 0–30 degrees range above horizontal, the method of the invention basically uses the top or bottom portion of the reflector 70 as a reference. By aiming it so that light reflected back into fixture 10 by lens 24 reflects perpendicularly into lens 24, essentially the remainder of the reflector is adjusted slightly downward and moves the image of the arc tube down where it is blocked at least in part by the arc tube and its supporting structure. The invention therefore uses structure in the fixture to block this glare. This allows the much cheaper conventional glass lens to be used without glare being a problem.

It is to be understood, however, that empirical testing must sometimes be done to reduce glare to the extent needed or desired, or to a minimum extent. Glare can be reduced by the foregoing method for at least viewing angles of 0 to 30 degrees to a horizontal plane through light source 82. However, glare from many, if not most, viewing angles may well be reduced.

Adjusting segments 100 to reduce glare according to the present invention is somewhat analogous to using bubble level. One may have to view the fixture from the viewing angle at which glare is desired to be reduced, and the bottom-most (or top-most) segment tilted back and forth until glare from that segment is blocked by the light source or its holder/support. Thereafter, the remaining segments 100 can be adjusted relative to the adjustment made to the bottom-most (or top-most segment 100, so that all are positioned to reduce glare.

What is claimed:

1. A method for minimizing glare from a lighting fixture having a light source, a primary reflector on the same order of size as the light source and positioned near or on one side of the light source, a secondary reflector larger than the primary reflector and spaced apart and on an opposite side of the light source from the primary reflector, and a housing containing the light source on a supporting holder, the primary reflector, and the secondary reflector, the housing including a planar glass lens through which light captured by the secondary reflector passes to a target, the glass lens having reflectance properties, the method comprising:

configuring the secondary reflector so that all parts of the reflector converge light from the light source and the primary reflector to the same point in space;

determining whether glare is created for a desired viewing angle to the fixture at any point on the secondary reflector by the re-imaging of the light source on the secondary reflector by reflectance from the lens;

adjusting the secondary reflector in the housing to cause one of top or bottom sections of the secondary reflector to reflect light from the light source perpendicularly to the lens;

aligning other sections of the secondary reflector relative to the one of the top or bottom sections to maintain convergence of light to the same point in space from all sections of the secondary reflector.

2. The method of claim 1 further comprising after aligning the other sections of the secondary reflector, positioning the housing in an orientation so the convergence of light is aimed to a selected target.

3. The method of claim 1 wherein the secondary reflector comprises a plurality of segments pivotally positioned adjacent one another along a preselected shape.

4. The method of claim 1 wherein the secondary reflector is one piece and manufactured in a preselected shape.

5. The method of claim 3 wherein the step of configuring the secondary reflector comprises aiming all segments so that light reflected from all segments converges to the same point in space.

6. The method of claim 4 wherein the step of configuring the secondary reflector comprises manufacturing the shape of the reflector relative to the focal length of the fixture, the size of the light source and the size of the secondary reflector so that light reflected from all portions of the secondary reflector converges to the same point in space.

7. The method of claim 5 wherein the step of adjusting the top or bottom portion of the secondary reflector comprises pivoting one of the top-most or bottom-most segments to re-aim that segment so that light is reflected from it perpendicularly into the lens.

8. The method of claim 6 wherein the step of adjusting the top or bottom portion of the secondary reflector comprises tipping the secondary reflector so that light from that portion is reflected from it perpendicularly into the lens.

9. The method of claim 7 wherein the step of aligning comprises pivoting the other segments of the secondary reflector so that each reflects light in a manner to converge to the same point in space as the adjusted top or bottom segment.

10. The method of claim 8 wherein the step of aligning comprises the step of tipping the secondary reflector of claim 8.

11. The method of claim 1 wherein the focal length is on the order of six inches and the reflector has a vertical dimension on the order of thirty two inches.

12. The method of claim 1 wherein the focal length is on the order of six inches and the reflector has a vertical dimension on the order of thirty two inches.

13. An apparatus for minimizing glare from a lighting fixture having a light source, a primary reflector on the same order of size as the light source and positioned near or on one side of the light source, a secondary reflector larger than the primary reflector and spaced apart and on an opposite side of the light source from the primary reflector, and a housing containing the light source on a supporting holder, the primary reflector, and the secondary reflector, the housing including a planar glass lens through which light captured by the secondary reflector passes to a target, the glass lens having reflectance properties, comprising:

the secondary reflector having all portions configured so that light reflected from all portions converges to the same point in space;

a first portion of the secondary reflector positioned relative to the light source, primary reflector, and lens so that light reflected from the first portion is perpendicular to the lens.

14. The apparatus of claim 13 wherein the secondary reflector is comprised of a plurality of segments, each individually adjustable.

15. The apparatus of claim 14 wherein said first portion is one of a top-most or bottom-most segment.

16. The apparatus of claim 14 wherein said first portion is a segment at or near the top of the secondary reflector.

17. The apparatus of claim 14 wherein said first portion is a segment at or near the bottom of the secondary reflector.

18. The apparatus of claim 13 wherein the secondary reflector is a single piece reflector.

19. The apparatus of claim 18 wherein said first portion is one of a top-most portion and a bottom-most portion.

20. The apparatus of claim 18 wherein said first portion is at or near the top of the secondary reflector.

21. The apparatus of claim 18 wherein said first portion is at or near the bottom of the secondary reflector.

22. A method for minimizing glare from a lighting fixture having a light source, a primary reflector on the same order of size as the light source and positioned near or on one side of the light source, a secondary reflector larger than the primary reflector and spaced apart and on an opposite side of the light source from the primary reflector compromising a plurality of portions, and a housing containing the light source on a supporting holder, the primary reflector, and the secondary reflector, the housing including a planar glass lens through which light captured by the secondary reflector passes to a target, the glass lens having reflectance properties, the method comprising:

configuring the secondary reflector so that all portions of the secondary reflector converge light from the light source and the primary reflector to the same point in space;

orienting one of the top or bottom portions of the secondary reflector relative to the lens to cause said one of the top or bottom portions of the secondary reflector to reflect light from the arc source perpendicularly to the lens;

aligning other portions of the secondary reflector relative to the one of the top or bottom portions to maintain convergence of light to the same point in space from all portions of the secondary reflector.

* * * * *